US007967279B2

(12) United States Patent
Monti et al.

(10) Patent No.: US 7,967,279 B2
(45) Date of Patent: Jun. 28, 2011

(54) CARBONATOR DEVICE

(75) Inventors: Silvano Monti, Buguggaiate (IT); Stefano Tavolazzi, Verbania-Intra (IT); Ferruccio Barzizza, Corgeno (IT)

(73) Assignee: Whirlpool Corporation, Benton Harbor, MI (US)

( * ) Notice: Subject to any disclaimer, the term of this patent is extended or adjusted under 35 U.S.C. 154(b) by 1020 days.

(21) Appl. No.: 11/775,926

(22) Filed: Jul. 11, 2007

(65) Prior Publication Data

US 2008/0012158 A1 Jan. 17, 2008

(30) Foreign Application Priority Data

Jul. 14, 2006 (EP) ..... 06117223

(51) Int. Cl.
*B01F 3/04* (2006.01)

(52) U.S. Cl. ..... 261/43; 261/DIG. 7; 99/323.1

(58) Field of Classification Search ..... 261/43, 261/DIG. 7; 99/323.1, 323.2; 426/477
See application file for complete search history.

(56) References Cited

U.S. PATENT DOCUMENTS

| | | | | | |
|---|---|---|---|---|---|
| 2,391,003 | A | * | 12/1945 | Bowman | 261/93 |
| 2,514,463 | A | * | 7/1950 | Bayers, Jr. | 261/130 |
| 3,730,500 | A | * | 5/1973 | Richards | 261/140.1 |
| 4,148,334 | A | * | 4/1979 | Richards | 137/389 |
| RE32,179 | E | * | 6/1986 | Sedam et al. | 261/26 |
| 4,597,509 | A | * | 7/1986 | Pereira | 222/129 |
| 4,745,853 | A | * | 5/1988 | Hoover | 99/323.1 |
| 4,764,315 | A | * | 8/1988 | Brusa | 261/140.1 |
| 4,950,431 | A | * | 8/1990 | Rudick et al. | 261/140.1 |
| 5,124,088 | A | * | 6/1992 | Stumphauzer | 261/121.1 |
| 5,417,147 | A | * | 5/1995 | Mason | 99/323.2 |
| 5,736,072 | A | * | 4/1998 | Satoh | 261/27 |
| 5,792,391 | A | * | 8/1998 | Vogel et al. | 261/121.1 |

* cited by examiner

*Primary Examiner* — Scott Bushey
(74) *Attorney, Agent, or Firm* — John W. Morrison; McKee, Vorhees & Sease, PLC

(57) ABSTRACT

The present invention relates to a carbonator device for use in refrigeration appliances and beverage distributors having a reservoir that has a tank portion and a lid portion and a plurality of connections for technical components provided on the lid portion. The reservoir is supplied with water and carbon dioxide and the technical components allow for a variety of water dispensing options.

17 Claims, 2 Drawing Sheets

CARBONATOR DEVICE

BACKGROUND OF THE INVENTION

1. Field of the Invention

The present invention relates to a carbonator device for use in refrigeration appliances or beverage distributors. More particularly, the present invention relates to a carbonator device having a reservoir adapted to contain water and which may be supplied with water and pressurised carbon dioxide.

2. Description of the Related Art

Carbonator units are currently available on the market, but typically require a series of external components to function. These components usually include a water pump, electrovalves, level sensors, and various other components. Additionally, the units require many fittings for water connections, have a long assembly time due to the construction complexity, and as a result are very expensive. A further drawback is that carbonator devices are usually installed in combination with a still water reservoir, which means two tanks are required—one for the still water and one for the carbonated water. In some cases there is only one reservoir, but this configuration still requires a large number of external components to operate the unit. As a result, carbonator units typically require a large amount of space due to the external components or multiple tanks.

SUMMARY OF THE INVENTION

Accordingly, the present invention is directed to a carbonator device for use in refrigeration appliances and beverage distributors.

One embodiment of the invention is a carbonator device having a reservoir that has a tank portion and a lid portion and a plurality of connections for technical components provided on the lid portion. The reservoir is supplied with water and carbon dioxide and the technical components allow for a variety of water dispensing options.

The tank portion and lid portion may be made of a polymeric material. The lid portion may be welded to the tank portion.

The technical components may include removable electrovalves and a pump for distributing water in the reservoir.

The lid may be connected to a water supply line. The water supply line may deliver water to a first electrovalve that is configured to deliver sill water at ambient temperature. The water supply line may deliver water to a heat exchanger provided in the reservoir for delivering cold, still water. The carbonator device may include a second and third electrovalve, provided in series with the first and second electrovalve. The first, second, and third electrovalves may be integrated as a single block. The second electrovalve may be configured to deliver cold, still water and the third electrovalve may be configured to deliver cold, carbonated water.

The carbonator device may also include at least one level sensor projecting into the reservoir and operably connected to a control unit. The control unit may be configured to activate the pump to refill the reservoir with water according to measurements from the level sensor.

The carbonator device may include a safety pressure valve for releasing extra pressure from the reservoir to the external air.

The carbonator device may further include an evaporator coil around the reservoir. There may also be a thermal insulation layer around the reservoir.

The carbonator device may include a temperature sensor provided within the reservoir.

BRIEF DESCRIPTION OF THE DRAWINGS

Further advantages and features of the present invention will become clearer from the following detailed description, with reference to the drawings, in which.

DETAILED DESCRIPTION OF THE PREFERRED EMBODIMENTS

Figure 1:
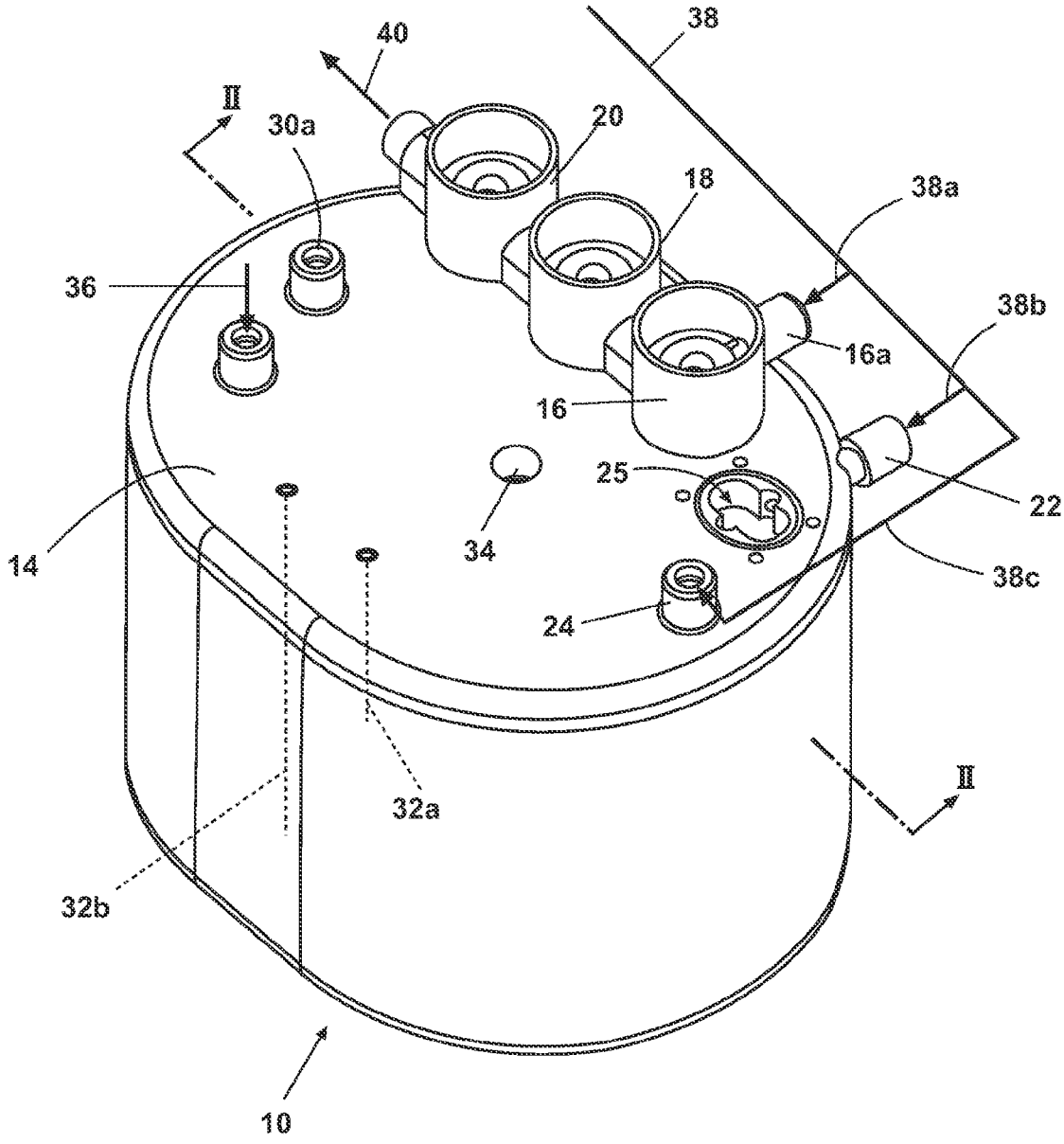
FIG. 1 is a perspective view of a carbonator device according to an embodiment of the invention.

With reference to FIG. 1, a carbonator device according to an embodiment of the invention is shown. The carbonator device may include a reservoir 10 having a lower tank 12 and an upper lid 14. The upper lid may be secured to the tank by ultrasonic welding or other fixation methods. The reservoir may be constructed of plastic or various other materials. The lower tank is substantially free of any external connections. Instead, the external connections are provided on the lid 14. In the embodiment shown, the lid has three electrovalve connections 16, 18 and 20 for interfacing with respective electrovalves. The electrovalve connections can be integrated in a single block or can be molded separately on the lid 14. Three exemplary electrovalve connections are shown, but other numbers are possible without departing from the scope of the invention. Additionally, the carbonator device may have a plurality of other connections. For example, the lid 14 may have a connection 25 for a liquid pump, an inlet 24 for a heat exchanger, a connection 30*a* for a temperature sensor, a connection 36 for a carbon dioxide input, and a connection 34 for a pressure valve. Each of these subsystems will be described in more detail in the following paragraphs. It can be readily understood that additional connections may be provided and any number of the above mentioned devices could be provided without altering the function of the invention.

Figure 2:
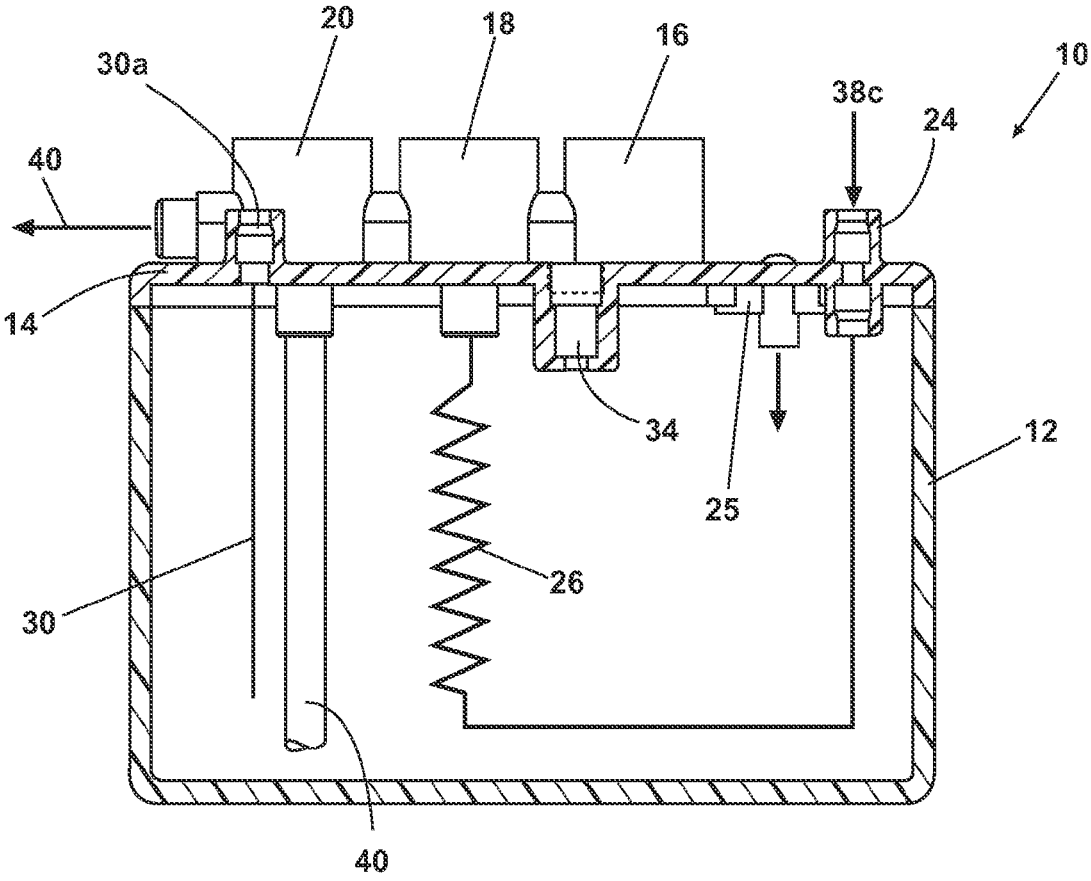
FIG. 2 is a cross section along line II-II of FIG. 1.

The carbonator device may be connected to a water tap line 38, which may distribute water via three different branches 38*a*, 38*b*, and 38*c*. A water filter may be provided between the water tap line 38 and the inlet to the carbonator device to filter the incoming water. Branch 38*a* of the water inlet 38 is connected to an inlet 16*a* of the first electrovalve connection 16. The second branch 38*b* is connected to an inlet 22 of the pump, which is connected to the lid 14 via its connection 25. The pump may be a gear pump or any other kind of volumetric pump, for instance a membrane pump or other types. The third branch 38*c* is connected to an inlet 24 for a heat exchanger 26. As shown in FIG. 2, the heat exchanger 26 may be immersed in water in the reservoir 10 and its output may be connected to the second electrovalve connection. The electrovalve connections may have a water outlet 40 connected to a dispenser area from which the user can fill a glass or other container.

The lid 14 may also have a temperature sensor 30 immersed in the water in the reservoir 10. The temperature sensor 30 is electrically linked via connection 30*a* with a control unit of the carbonator device. Furthermore, the lid may contain a level sensing system having at least one sensing element. In the embodiment shown, two sensing elements 32*a* and 32*b* are provided for determining the amount of water in the reservoir 10. The number of sensing elements can be changed depending on the level of accuracy desired. The lid 14 may also have a safety pressure valve installed in an aperture 34 for releasing excess pressure, and a carbon dioxide input 36 for introducing carbon dioxide. Double check valves can also be used for the safety valve. Each of the external components can be easily installed and removed from the provided connections.

In operation, when the electrovalve associated with the first connection 16 is open and the other two electrovalves are closed, the water outlet 40 is configured to deliver still water at ambient temperature. As shown in FIG. 2, still water travels from the water tap line 38 to the first branch 38*a*, and then through the electrovalve at connection 16 and finally to the water outlet 40. Thus, still water at ambient temperature is dispensed. When only the electrovalve associated with the second connection 18 is open, the carbonator device delivers cold, still water. As shown in FIG. 2, the water is refrigerated by its passage through the tube heat exchanger 26. Still cold water is dispensed by following the path from the water tap line 38 to the third branch 38*c*, then to inlet 24 and through the heat exchanger 26, through the electrovalve at connection 18 and finally to the water outlet 40. When only the electrovalve associated with the third electrovalve connection 20 is open, the device delivers cold carbonated water. To produce carbonated water, the pump increases the pressure of the water from the incoming line 38 until it reaches the pressure within the reservoir 10. For example, when the reservoir 10 is first installed, it is empty and may be connected to a carbon dioxide line 36 and to a water line 38 by a water connection 22. Level sensors 32*a* and 32*b* are provided in the reservoir 10 to detect if the reservoir 10 needs to be refilled. If it does, the pump is activated. When the correct water level is reached, the pump stops and pressurized water is contained in the reservoir 10. Thus, carbonated water is ready to be dispensed through line 40. Therefore, depending on which button the user is selecting, the carbonator device is able to deliver cold carbonated, cold still, and still ambient water.

Another embodiment of the invention includes an evaporator coil wrapped around the exterior of the reservoir 10 in order to cool down the reservoir 10 during operation. Additionally, a thermal insulation layer may be provided around the coil. Alternatively, the reservoir 10 can be placed in a cavity of a refrigerator, in which case the insulation layer is not required.

In case of any over pressure of water or carbon dioxide, a safety valve may be mounted on the aperture 34 to release the extra pressure to the ambient air.

The construction according to the present invention can integrate many components together in a small space. Other advantages include a reduced assembly and unit cost, an easily replaceable unit, fewer connections, and a smaller size compared to a traditional carbonator device.

While the present invention has been described with reference to the above described embodiments, those of skill in the art will recognize that changes may be made thereto without departing from the scope of the invention as set forth in the appended claims.

We claim:

1. A carbonator device for use in refrigeration appliances and beverage distributors, comprising:

a reservoir having a tank portion and a lid portion wherein the lid portion is connected to a water supply line;

the water supply line delivers water to a plurality of connections for technical components provided on the lid portion, comprising:

a first electrovalve configured to deliver still water at ambient temperature;

a heat exchanger provided in the reservoir to deliver cold, still water;

a second and third electrovalve, provided in series with the first electrovalve; and wherein the reservoir is supplied with water and carbon dioxide and the technical components allow for a variety of water dispensing options.

2. The carbonator device of claim 1, wherein the tank portion and the lid portion are made of a polymeric material.

3. The carbonator device of claim 2, wherein the lid portion is welded to the tank portion.

4. The carbonator device of claim 1, wherein the technical components comprise removable electrovalves and a pump for distributing water in the reservoir.

5. The carbonator device of claim 1, wherein the first, second, and third electrovalves are integrated as a single block.

6. The carbonator device of claim 1, wherein the second electrovalve is configured to deliver cold, still water and the third electrovalve is configured to deliver cold, carbonated water.

7. The carbonator device of claim 4, further comprising at least one water level sensor projecting into the reservoir and operably connected to a control unit.

8. The carbonator device of claim 7, wherein the control unit is configured to activate the pump to refill the reservoir with water according to measurements from the at least one water level sensor.

9. The carbonator device of claim 1, further comprising a safety pressure valve for releasing extra pressure from the reservoir to the external air.

10. The carbonator device of claim 1, further comprising an evaporator coil around the reservoir.

11. The carbonator device of claim 10, further comprising a thermal insulation layer around the reservoir.

12. The carbonator device of claim 1, further comprising a temperature sensor provided within the reservoir.

13. A carbonator device provided within a refrigerator comprising:

a reservoir having a tank portion and a lid portion;

a plurality of connections for technical components provided on the lid portion, comprising:

a least a first electrovalve provided in series with a second electrovalve to separately deliver both cold and carbonated water from the same reservoir; and wherein the reservoir is supplied with water and carbon dioxide and the technical components allow for a variety of water dispensing options.

14. The device of claim 13 further comprising a heat exchanger enclosed in the reservoir to provide the cold water.

15. The device of claim 13 further comprising a third electrovalve provided in series with the first and second electrovalves to deliver ambient temperature water.

16. A carbonator device comprising:

a tank having a single reservoir enclosed by a lid; and a plurality of connections for technical components provided at the lid comprising:

a carbonated and cold water outlet at the lid both connected in fluid communication with the single reservoir to deliver carbonated and cold water separately from the same single reservoir.

17. The device of claim 16 further comprising an electrovalve at the carbonated and cold water outlets to selectively deliver either carbonated water or cold water from the same single reservoir.

* * * * *